US005426559A

United States Patent [19]

Cox

[11] Patent Number: 5,426,559

[45] Date of Patent: Jun. 20, 1995

[54] CONTROL CIRCUIT FOR IGNITION SPARK IN INTERNAL COMBUSTION ENGINES

[75] Inventor: Michael A. Cox, Huntsville, Ala.

[73] Assignee: Chrysler Corporation, Highland Park, Mich.

[21] Appl. No.: 56,150

[22] Filed: Apr. 30, 1993

[51] Int. Cl.[6] ..... F23Q 3/00

[52] U.S. Cl. ..... 361/253; 361/189

[58] Field of Search ..... 361/143, 152, 153, 154, 361/160, 170, 187, 189, 206, 247, 213, 190, 191

[56] References Cited

U.S. PATENT DOCUMENTS 4,338,651 7/1982 Henrich ..... 361/154

4,479,161 10/1984 Henrich et al. ..... 361/154

4,846,129 7/1989 Noble ..... 123/425

4,950,974 8/1990 Pagano ..... 361/191

5,099,811 3/1992 Frantz et al. ..... 123/416

*Primary Examiner*—Jeffrey A. Gaffin

*Attorney, Agent, or Firm*—Mark P. Calcaterra

[57] ABSTRACT

An ignition control circuit for an internal combustion engine having at least two spark plugs and two coils to provide a spark upon de-energization of the coils. The circuit also includes an output circuit connected to the coils to regulate current flow to energize the coils and a driver circuit connected to the output circuit to control the voltage to the output circuit in response to an input signal to the driver circuit.

10 Claims, 1 Drawing Sheet

CONTROL CIRCUIT FOR IGNITION SPARK IN INTERNAL COMBUSTION ENGINES

BACKGROUND OF THE INVENTION

1. Field of the Invention

The present invention relates generally to internal combustion engines and, more particularly, to a control circuit for controlling ignition spark in internal combustion engines.

2. Description of the Related Art

In a standard ignition control circuit for an internal combustion engine, a Darlington transistor is typically turned ON which allows current to flow through a coil. When a desired current level is reached, the control circuit controls current flowing into the base of the Darlington transistor to limit the current in the coil. Then, at the proper time, the Darlington transistor is turned OFF and a flyback voltage appears across the coil, which causes a spark to jump across the airgap of a spark plug. However, there is a need in the art to provide a more efficient control circuit for controlling the ignition spark in internal combustion engines. There is also a need in the art to provide an ignition control circuit which is much simpler than the standard ignition control circuit.

SUMMARY OF THE INVENTION

It is, therefore, one object of the present invention to provide an ignition control circuit for an internal combustion engine.

It is another object of the present invention to provide an ignition control circuit for controlling the ignition spark in an internal combustion engine.

It is a further object of the present invention to provide a simpler ignition control circuit.

To achieve the foregoing objects, the present invention is an ignition control circuit for an internal combustion engine having at least two spark plugs and two coils to provide a spark upon de-energization of the coils. The circuit also includes an output circuit connected to the coils to regulate current flow to energize the coils and a driver circuit connected to the output circuit to control the voltage to the output circuit in response to an input signal to the driver circuit.

One advantage of the present invention is that a new and improved ignition control circuit is provided for an internal combustion engine. Another advantage of the present invention is that an ignition control circuit is provided which controls the ignition spark in an internal combustion engine. Yet another advantage of the present invention is that a much simpler ignition control circuit is provided which uses a voltage controlled device rather than a current controlled Darlington transistor.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
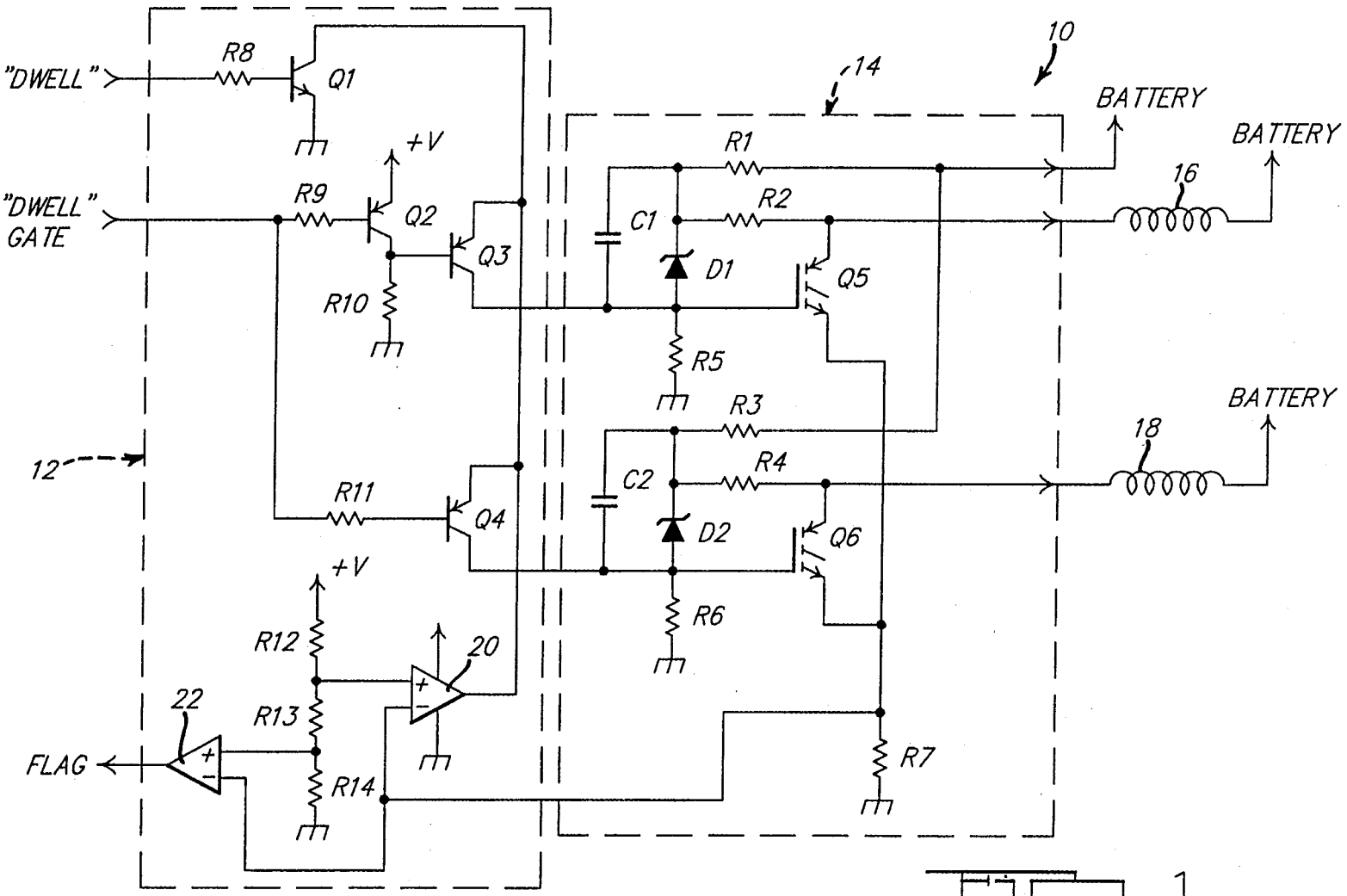
FIG. 1 is a schematic diagram of an ignition control circuit according to the present invention.

Referring to FIG. 1, an ignition control circuit 10 is shown for an internal combustion engine (not shown). The ignition control circuit 10 includes a driver circuit, generally indicated at 12, and an output circuit, generally indicated at 14. The ignition control circuit 10 also includes a first inductor or coil 16 and a second inductor or coil 18 connected to the output circuit 14. It should be appreciated that the coils 16, 18 provide current to spark plugs (not shown) of the engine upon de-energization.

The output circuit 14 includes a resistor R1 and a capacitor C1 connected in series and to a source of power, $V_{BAT}$, such as a vehicle battery (not shown). The output circuit 14 also includes a resistor R2 interconnecting the first coil 16 and the resistor R1 and capacitor C1. The output circuit 14 includes a resistor R3 and a capacitor C2 connected in series and connected between the resistor R1 and $V_{BAT}$. The output circuit 14 also includes a resistor R4 interconnecting the second coil 18 and the resistor R3 and capacitor C2. The output circuit 14 includes a diode D1 and a resistor R5 connected in series and interconnecting the resistor R2 and ground. The output circuit 14 includes a diode D2 and a resistor R6 connected in series and interconnecting the resistor R4 and ground. The output circuit 14 includes a transistor Q5 whose source interconnects the diode D1 and resistor R5 and whose drain interconnects the resistor R2 and the first coil 16. The output circuit 14 includes a transistor Q6 whose gate interconnects the diode D2 and resistor R6 and whose collector interconnects the resistor R4 and the second coil 18. The output circuit 14 further includes a resistor R7 interconnecting the gate of the transistors Q5 and Q6 and ground.

The driver circuit 12 includes a transistor Q1 whose emitter is connected to ground and a resistor R8 connected to the base of the transistor Q1. The driver circuit 12 includes an Op Amp 20 whose output is connected to the collector of the transistor Q1. The driver circuit 12 includes a transistor Q2 whose collector is connected to a source of power, V, and a resistor R9 connected to the base of the transistor Q2. It should be appreciated that the resistors R8 and R9 are connected to an engine controller (not shown) which provides input signals "DWELL" and "DWELL GATE".

Although not a part of the present invention, the two input signals which effectively select which coil is to be energized are created by a distributor or any other type of controller well known in the art.

The driver circuit 12 also includes a resistor R10 interconnecting the emitter of the transistor Q2 and ground. The driver circuit 12 includes a transistor Q3 whose base interconnects the emitter of the transistor Q2 and the resistor R10. The transistor Q3 has its collector connected to the collector of the transistor Q1 and its gate connected to the source of the transistor Q5 of the output circuit 14. The driver circuit 12 includes a transistor Q4 whose collector is connected to the output of the OpAmp 20 and whose emitter is connected to the base of the transistor Q6 of the output circuit 14. The driver circuit 12 also includes a resistor R11 interconnecting the resistor R9 and the base of the transistor Q4. The driver circuit 12 includes resistors R12, R13 and R14 connected in series and interconnecting the source of power, V, and ground. The driver circuit 12 further includes an Op Amp 22 having its non-inverted input interconnecting resistors R13 and R14 and its inverted input connected to the inverted input of Op Amp 20.

In operation, a "dwell gate" input from the engine controller is used to choose the coil 16 or 18 to be energized. If the "dwell gate" is high, the transistor Q2 is ON which will then turn ON the transistor Q3, activating the first coil 16. If the "dwell gate" is low, the transistor Q4 is ON, activating the second coil 18. If the "dwell" input from the engine controller is high, the output of the Op Amp 20 is shorted to ground. If the "dwell" input is low, the transistor Q1 is OFF and the output voltage of the OpAmp 20 is connected to the gate of the transistor Q5 or Q6 (depending on the level of the "dwell gate" input).

If it is assumed that the "dwell gate" input is high, the transistor Q3 will be ON and the gate voltage of the transistor Q5 is supplied by the output of the Op Amp 20. With voltage on the gate, transistor Q5 will turn ON, allowing current to flow through the first coil 16, transistor Q5, and resistor R7. As the current increases, the voltage across the resistor R7 rises. When the current through resistor R7 increases to the point that the voltage at the negative input of the Op Amp 20 exceeds the voltage at the positive input, the output voltage of the Op Amp 20 will drop, which will lower the gate voltage of the transistor Q5, which will decrease the current through the first coil 16, which will lower the voltage across the resistor R7, which will lower the voltage at the negative input of the Op Amp 20. Thus, the resistor R7 and Op Amp 20 provide feedback to limit the current in the coils 16, 18 to an amount determined by the voltage applied to the positive input. The current through the first coil 16 will continue to flow at its limited value until the "dwell" input signal goes high, which causes the output of Op Amp 20 to be shorted to ground through the transistor Q1 which removes voltage from the gate of the transistor Q5, hence turning it OFF. Then a flyback voltage spike will appear across the first coil 16 with it's upper value limited by the voltage divider formed by the resistors R1 and R2 and the zener diode D1. Also, the Op Amp 22 is used as a flag that will go low when the current through the coils 16, 18 exceeds a predetermined amount.

However, if the "dwell gate" input is low, the transistor Q4 will be turned ON. The gate voltage of the transistor Q6 will then be supplied by the output of the Op Amp 20. The transistor Q6 will be turned ON with voltage applied to its gate. This will allow current to flow through the second coil 18, transistor Q6, and resistor R7. As the current increases, the voltage across the resistor R7 will also increase. When the voltage at the negative input of the Op Amp 20 exceeds the voltage on the positive input, due to an increase in the current through the resistor R7, the output voltage of the Op Amp 20 will decrease. This, in turn, will lower the voltage at the gate of the transistor Q6, across the resistor R7, and at the negative input of the Op Amp 20 while also decreasing the current in the second coil 18. With this feedback, the current through the second coil 18 will continue to flow at its limited value until the "dwell" input signal goes high. This will cause the output of the Op Amp 20 to be shorted to ground through the transistor Q1 which removes the voltage from the gate of the transistor Q6, turning it OFF. A flyback voltage spike will then appear across the second coil 18 with its upper value limited by the voltage divider formed by the resistors R3 and R4 and the diode D2. The Op Amp 22 will be used as a flag that goes low when the current through the coils 16, 18 exceed a predetermined amount.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An ignition control circuit for controlling an output of a plurality of coils used to ignite fuel in an internal combustion engine, said ignition control circuit comprising:

a driver circuit having at least two switches and at least two input terminals, said driver circuit receiving voltage signals at said at least two input terminals to operate said at least two switches such that the plurality of coils discharge voltage accumulated thereacross; and an output circuit connected between the plurality of coils and said at least two switches of said driver circuit, said output circuit comparing a voltage across a portion thereof with a voltage across a portion of said driver circuit to maintain current flowing through the plurality of coils at a predetermined value wherein the voltage across each of the plurality of coils is controlled by said predetermined value of the current.

2. An ignition control circuit for an internal combustion engine comprising:

a first coil and a second coil;

means for choosing either one of said first and second coil to be energized;

means for energizing said first coil;

means for energizing said second coil;

means for feedback control to limit energy entering said coils; and means for detecting when current in said coils exceeds a predetermined amount to operate said means for feedback control such that the current drops below said predetermined amount.

3. An ignition control circuit as set forth in claim 2 including a first transistor connected to said first coil and a second transistor connected to said second coil.

4. An ignition control circuit as set forth in claim 3 wherein said means for choosing comprises a third transistor to conduct current if an input signal is high, a fourth transistor connected to a collector of the said third transistor to control operating of said first transistor, a fifth transistor connected to a second input to control operation of said second transistor when an input signal is low, and a plurality of resistors to regulate voltage at said first and second transistors.

5. An ignition control circuit an ignition control circuit for an internal combustion engine comprising:

a first coil and a second coil;

means for energizing said first coil;

means for energizing said second coil;

means for feedback control to limit energy entering said coils;

means for detecting when current in said coils exceeds a predetermined amount to operate said means for feedback control such that the current drops below said predetermined amount;

a first transistor connected to said first coil and a second transistor connected to said second coil;

a third transistor to conduct current if an input signal is high, a fourth transistor connected to a collector of the said third transistor to control operating of said first transistor, a fifth transistor connected to a second input to control operation of said second transistor when an input signal is low, and a plurality of resistors to regulate voltage at said first and second transistors; and a first operational amplifier, a sixth transistor connected to the second input via its gate and said first operational amplifier via its source, said sixth transistor conducting and shorting said first operational amplifier to ground when the second input is high, said sixth transistor not conducting when the second input is low and said first operational amplifier supplying output voltage to a collector of either said third or fourth transistor.

6. An ignition control circuit as set forth in claim 5 wherein said means for energizing first coil comprises said fifth transistor connected to an emitter of said third transistor, said fifth transistor conducting current through said first coil when a voltage is placed upon its gate by the emitter of said third transistor, a voltage divider and zener diode connected across the gate and drain of said fifth transistor which limits an upper value of a voltage spike that appears across said first coil when said fifth transistor stops conducting.

7. An ignition control circuit as set forth in claim 5 wherein said means for energizing said second coil comprises said sixth transistor connected to an emitter of said fourth transistor, said sixth transistor conducting current through said second coil when a voltage is placed upon its gate by the emitter of said fourth transistor, a voltage divider and zener diode connected across the gate and drain of said fifth transistor which limits the upper value of the voltage spike that appears across said second coil when said second transistor stops conducting.

8. An ignition control circuit as set forth in claim 5 wherein said means for feedback control comprises a resistor connected to a source of both said fifth and sixth transistors which will allow current to flow from said coils through said transistor and into said resistor, said resistor also connected to an inverting input of said first operational amplifier to compare the voltage to a predetermined value in order to control the current flow into said coils, a second operational amplifier connected to said inverting input of said first operational amplifier in order to act as a flag which goes low when the current through said coils exceeds a predetermined amount, and a voltage divider between said first and second operational amplifier.

9. An ignition control circuit for an internal combustion engine comprising:

a driver circuit, including a first transistor, a first resistor connected to the base of said first transistor and a first input line, a second transistor, a second resistor connected to a base of said second transistor and a second input line, a third transistor connected between its base and a collector of said second transistor, a third resistor connected between the base of said third transistor and ground, a collector of said first transistor connected to an emitter of said third transistor, a fourth transistor, a fourth resistor connected between the second input line and a base of said fourth transistor, an emitter of said third transistor connected to an emitter of said fourth transistor, a voltage divider, a first and second operational amplifier (OP AMP) connected between their negative terminals, said first Op Amp connected to said voltage divider via its positive terminal, said second Op Amp connected to said voltage divider via its positive terminal, said voltage divider connected between a power supply and said ground, and an output terminal of said second Op Amp connected to the emitter said fourth transistor; and an output circuit, including a fifth transistor connected to the collector of said third transistor, a second voltage divider connected between a battery and the drain of said fifth transistor, a first zener diode connected between the second voltage divider and the gate of said fifth transistor, a first capacitor in parallel with said first zener diode, a fifth resistor between the gate of said fifth transistor and ground, a first coil connected between said battery and the drain of said fifth transistor, a sixth transistor connected to the collector of said fourth transistor, a third voltage divider connected between said battery and the drain of said sixth transistor, a second zener diode connected between said third voltage divider and the gate of said sixth transistor, a second capacitor in parallel to said second zener diode, a sixth resistor between the gate of said sixth transistor and said ground, the source of said sixth transistor connected to the source of said fifth transistor, a second coil connected between said battery and the drain of said sixth transistor, a seventh resistor connected between the source of said sixth transistor and said ground, and said seventh resistor also connected to the negative terminal of said second Op Amp.

10. A control circuit as set forth in claim 9 wherein said first voltage divider includes a first resistor connected between said power supply and said base, a second resistor connected between said first resistor and the drain of said fifth transistor, and a third resistor connected between said power supply and said ground.

* * * * *